US006331842B1

(12) United States Patent
Nozu et al.

(10) Patent No.: US 6,331,842 B1
(45) Date of Patent: Dec. 18, 2001

(54) METHOD FOR DRIVING A PLASMA DISPLAY PANEL

(75) Inventors: Mitsunori Nozu; Kimio Amemiya; Tsutomu Tokunaga, all of Yamanashi-ken (JP)

(73) Assignee: Poineer Electric Corporation, Tokyo (JP)

( * ) Notice: Subject to any disclaimer, the term of this patent is extended or adjusted under 35 U.S.C. 154(b) by 0 days.

(21) Appl. No.: 09/050,026

(22) Filed: Mar. 30, 1998

(30) Foreign Application Priority Data

Apr. 2, 1997 (JP) ..... 9-099752

(51) Int. Cl.[7] ..... G09G 3/28
(52) U.S. Cl. ..... 345/60; 345/41; 345/64
(58) Field of Search ..... 345/60–69, 41; 30/776

(56) References Cited

U.S. PATENT DOCUMENTS 4,772,884 * 9/1988 Weber et al. ..... 340/776
5,420,602 * 5/1995 Kanazawa ..... 345/67
5,436,634 * 7/1995 Kanazawa ..... 345/67
5,483,252 * 1/1996 Shigeta ..... 345/67
5,995,069 * 11/1999 Tokunaga et al. ..... 345/60

* cited by examiner

*Primary Examiner*—Steven Saras
*Assistant Examiner*—Srilakshmi Kumar
(74) *Attorney, Agent, or Firm*—Arent Fox Kintner Plotkin & Kahn, PLLC

(57) ABSTRACT

A plasma display panel has a plurality of first and second sustain electrodes, a plurality of address electrodes which intersect with the sustain electrodes to form a pixel at every intersection. In the method, an address period is provided, in which data pulses are applied to the address electrodes, and scanning pulses are applied to the second sustain electrodes, thereby selecting lighted pixels and unlighted pixels. A discharge sustaining period is provided, in which discharge sustaining pulses are alternately applied to the first and second sustain electrodes so as to sustain the lighted and unlighted pixels. An offset voltage having the same polarity as the data pulse is applied to the address electrodes in the discharge sustaining period.

4 Claims, 7 Drawing Sheets

METHOD FOR DRIVING A PLASMA DISPLAY PANEL

BACKGROUND OF THE INVENTION

The present invention relates to a method for driving a plasma display panel (PDP) of a surface discharge type.

Recently, as a display device becomes large in size, thickness of the display device is desired to be thin. Therefore, various types of display devices of thin thickness are provided. As one of the display devices, an ACPDP is known.

A conventional ACPDP comprises a plurality of data electrodes (address electrodes) and a plurality of row electrodes (sustain electrodes) formed in pairs and disposed to intersect the data electrodes. A pair of row electrodes form one row (one scanning line) of an image. The data electrodes and the row electrodes are covered by dielectric layers respectively, at a discharge space. At the intersection of each of the data electrodes and each pair of row electrodes, a discharge cell (pixel) is formed. Each of the row electrodes comprises a transparent electrode and a bus electrode layered on the transparent electrode.

FIG. 6 shows a timing chart of drive signals for driving the ACPDP.

A reset pulse RPx of negative voltage is applied to each of the row electrodes X1–Xn, and a reset pulse RPy of positive voltage is applied to each of the row electrodes Y1–Yn. Thus, the row electrodes in pairs are excited to discharge at all of the discharge cells, thereby producing charged particles in the discharge space. Thereafter, when the discharge is finished, wall charge is formed and accumulated on the discharge cell (A reset all at once period).

Then, pixel data pulses DP1–DPn corresponding to the pixel data for every row are applied to the pixel data electrodes D1–Dm in order. At that time, scanning pulses (selecting and erasing pulses) SP are applied to the row electrodes Y1–Yn in order in synchronism with the timings of the data pulse DP1–DPn.

At the time, only in the discharge cell (unlighted pixel, unlighted cell) to which the scanning pulse SP and the pixel data pulse DP are simultaneously applied, the discharge occurs, so that the wall charge produced at the reset all at once period is erased.

On the other hand, in the discharge cell (lighted pixel, lighted cell) to which only the scanning pulse SP is applied, the discharge does not occur. Thus, the wall charge produced at the reset all at once period is held. Namely, the wall charge is selectively erased in accordance with the pixel data, thereby selecting a lighted pixel and an unlighted pixel (An address period).

A discharge sustaining pulse IPx of positive voltage is applied to the row electrodes X1–Xn, and a discharge sustaining pulse IPy of positive voltage is applied to each of the row electrodes Y1–Yn at offset timing from the sustaining pulses IPx.

During the sustaining pulses are applied, the discharge cell (lighted pixel, lighted cell) which holds the wall charge sustains the discharge and emission of light. On the other hand, the discharge cell (unlighted pixel, unlighted cell) in which the wall charge is disappeared does not produce the discharge and emit the light (A discharge sustaining period).

Then, wall charge erasing pulses EP are applied to the row electrodes Y1–Yn all at once, thereby erasing the wall charges on all of the discharge cells (lighted cells) (A wall charge erasing period).

From the foregoing, in the PDP, the reset all at once period, address period, discharge sustaining period and wall charge erasing period are repeated as one display cycle, thereby displaying the image.

In such a method, during the discharge sustaining period, an unlighted cell may start discharging influenced by an adjacent lighted cell. The reason will be supposed as described hereinafter with reference to FIGS. 7*a* to 7*d*. In FIGS. 7*a* to 7*d*, the row electrodes X and Y are disposed in pair so as to be alternately changed in the position such as X-Y and Y-X. The row electrodes X and Y consist of a lighted cell, and the row electrodes Y and X consist of an unlighted cell. Each of the row electrodes Y has a positive polarity.

Normally, during the address period, in the unlighted cell, minus charges are accumulated on the data electrode D, and plus charges are accumulated on the row electrodes X and Y by selecting and erasing discharge. However, in a sub-field, if the erasing discharge is insufficient in the wall charge erasing period after the discharge sustaining period, and hence the wall charges remain on the row electrodes X and Y at portions opposite to the discharge gap G, the wall charge by selecting and erasing discharge is added to the residual wall charges. The wall charges are accumulated on the residual wall charges.

Therefore, as shown in FIG. 7*a*, in the unlighted cell, during the discharge sustaining period, immediately before the sustaining pulse by which the error discharge may occur is applied, an electric field E of the row electrode Y of the positive polarity toward the data electrode D becomes strong.

If the distance between adjacent display lines (distance between the adjacent row electrodes Y) is small, influence of the priming particles of the lighted cell on the unlighted cell becomes large.

Then, as shown in FIG. 7*b*, when the next discharge sustaining pulse is applied to the row electrode Y, the discharge of the lighted cell is transferred to the adjacent unlighted cell. Therefore, unnecessary discharge produces between the data electrode d and the row electrode Y of the unlighted cell.

As shown in FIG. 7*c*, because of the unnecessary discharge, the positive polarity of the wall charges on the row electrode Y is converted into the negative polarity. Thus, a difference of potential produces between the row electrodes X and Y of the unlighted cell.

As shown in FIG. 7*d*, when a further discharge sustaining pulse is applied, the error discharge produces on the unlighted cell.

The influence of the discharge for the error discharge further increases because of defect in portions for dividing the discharge cell or deflection of a pair of substrates, thereby deteriorating a manufacturing yield of the PDP. Furthermore, in order to obtain the PDP of high definition by reducing the size of discharge cell or the pitch of the scanning line, the distance between the adjacent discharge cells is reduced. Therefore, the error discharge is liable to occur.

SUMMARY OF THE INVENTION

An object of the present invention is to provide a driving method for a plasma display panel of a surface discharge type in which the above mentioned problems are solved, thereby preventing an error discharge in a discharge sustaining period, and hence improving the display characteristic.

According to the present invention, there is provided a method for driving a plasma display panel having a plurality of first and second sustain electrodes, a plurality of address electrodes which intersect with the sustain electrodes to form a pixel at every intersection, an address period in which data pulses are applied to the address electrodes, and scanning pulses are applied to the second sustain electrodes, thereby selecting lighted pixels and unlighted pixels, and a discharge sustaining period in which discharge sustaining pulses are alternately applied to the first and second sustain electrodes so as to sustain the lighted and unlighted pixels, comprising applying an offset voltage having the same polarity as the data pulse to the address electrodes in the discharge sustaining period.

The method further comprises a reset period before the address period in which a plurality of reset pulses are applied to all of the electrodes so as to form a wall charge in each of the pixels, the data pulses and scanning pulses are selectively applied to the electrodes, thereby selectively erasing the wall charges so as to select the lighted pixels and unlighted pixels.

These and other objects and features of the present invention will become more apparent from the following detailed description with reference to the accompanying drawings.

DETAILED DESCRIPTION OF THE PREFERRED EMBODIMENTS

Figure 1:
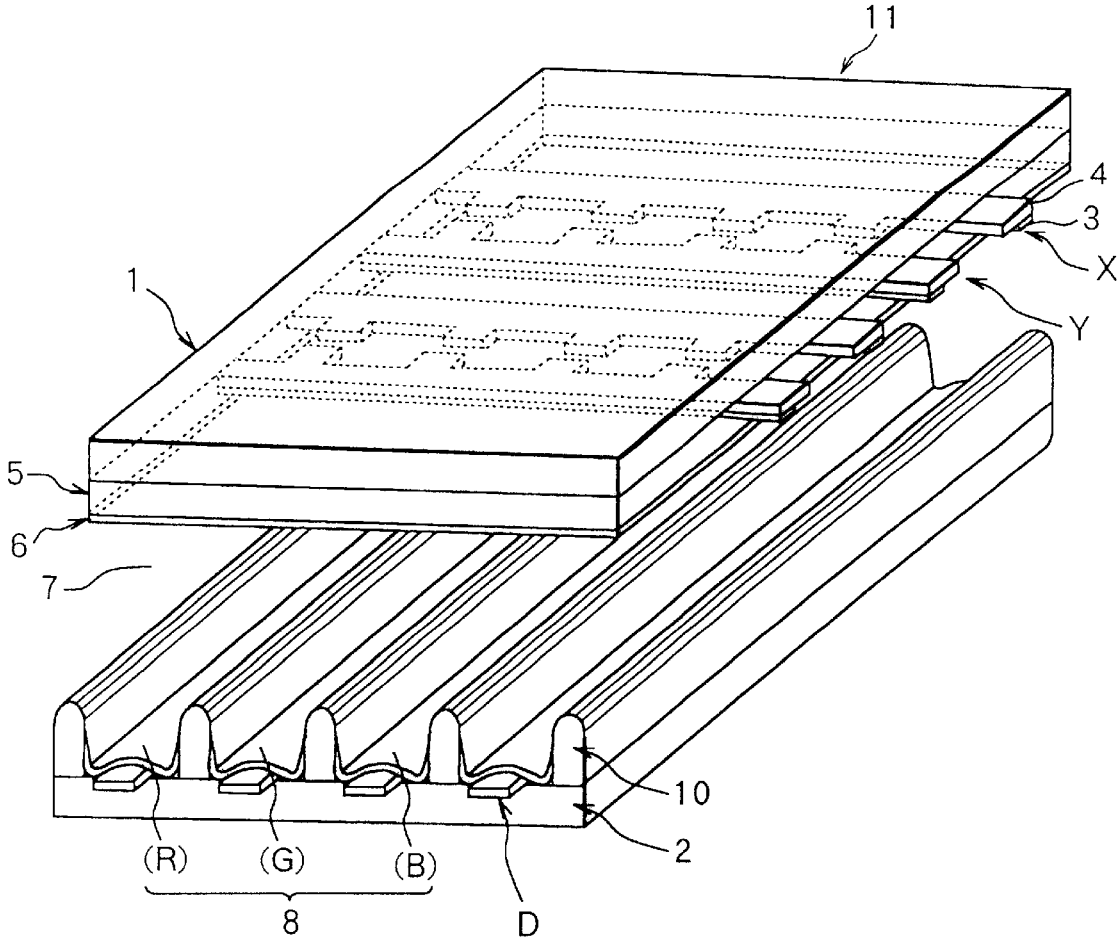
FIG. 1 is a schematic perspective view showing a plasma display panel of surface discharge type according to the present invention.

FIG. 1 shows a PDP of a surface discharge type according to the present invention. A PDP 11 comprises a pair of glass substrates 1 and 2 disposed opposite to each other, interposing a discharge space 7 therebetween. The glass substrate 1 as a display portion has row electrodes (sustain electrodes) X and Y which are alternately disposed in pairs to be parallel with each other at the inside portion thereof. The row electrodes X and Y are covered by a dielectric layer 5 for producing wall charge. A protection layer 6 made of MgO is coated on the dielectric layer 5.

Each of the row electrodes X and Y comprises a transparent electrode 4 formed by a transparent conductive film having a large width and a bus electrode (metallic electrode) 3 formed by a metallic film having a small width and layered on the transparent electrode 4.

On the glass substrate 2 as a rear member, a plurality of elongated barriers 10 are provided at the inside portion thereof for defining the discharge space 7. The barrier 10 extends in the direction perpendicular to the row electrodes X, Y. Between the barriers 10, data electrodes (address electrodes) D are formed to intersect the row electrodes X and Y of the glass substrate 1. A phosphor layer 8 having a predetermined luminous color R, G or B covers each of the data electrodes D and opposite side portions of the barrier 10. The discharge space 7 is filled with discharge gas consisting of neon mixed with xenon. Thus, a discharge cell (pixel) is formed at the intersection of the row electrodes in pairs and the data electrode.

Figure 2:
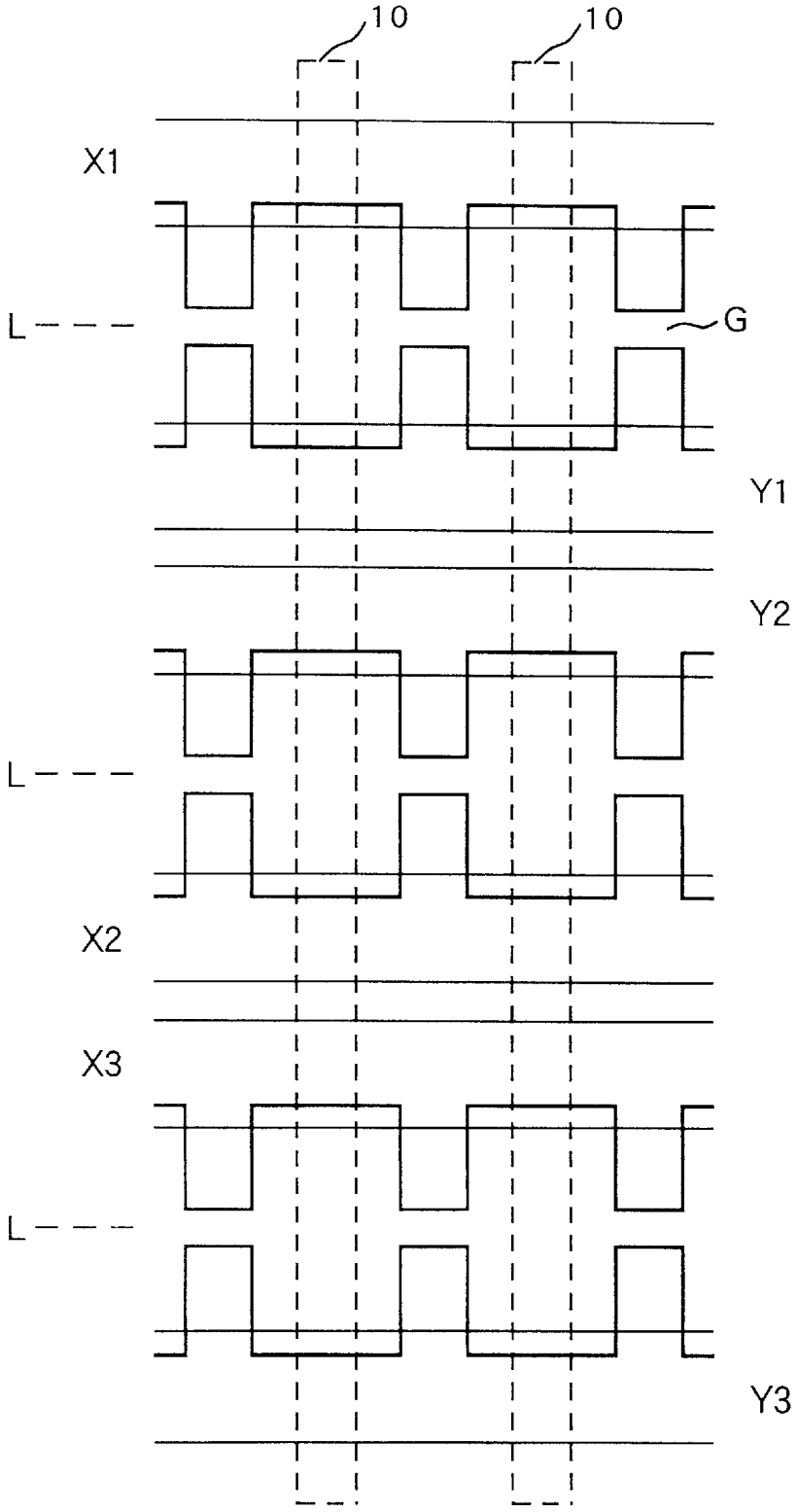
FIG. 2 is a schematic plan view showing the plasma display panel.

Referring to FIG. 2, in the PDP 11, the row electrodes X and Y are disposed so as to alternately change the position at every display line L such as X1–Y1, Y2–X2, X3–Y3.

Figure 3:
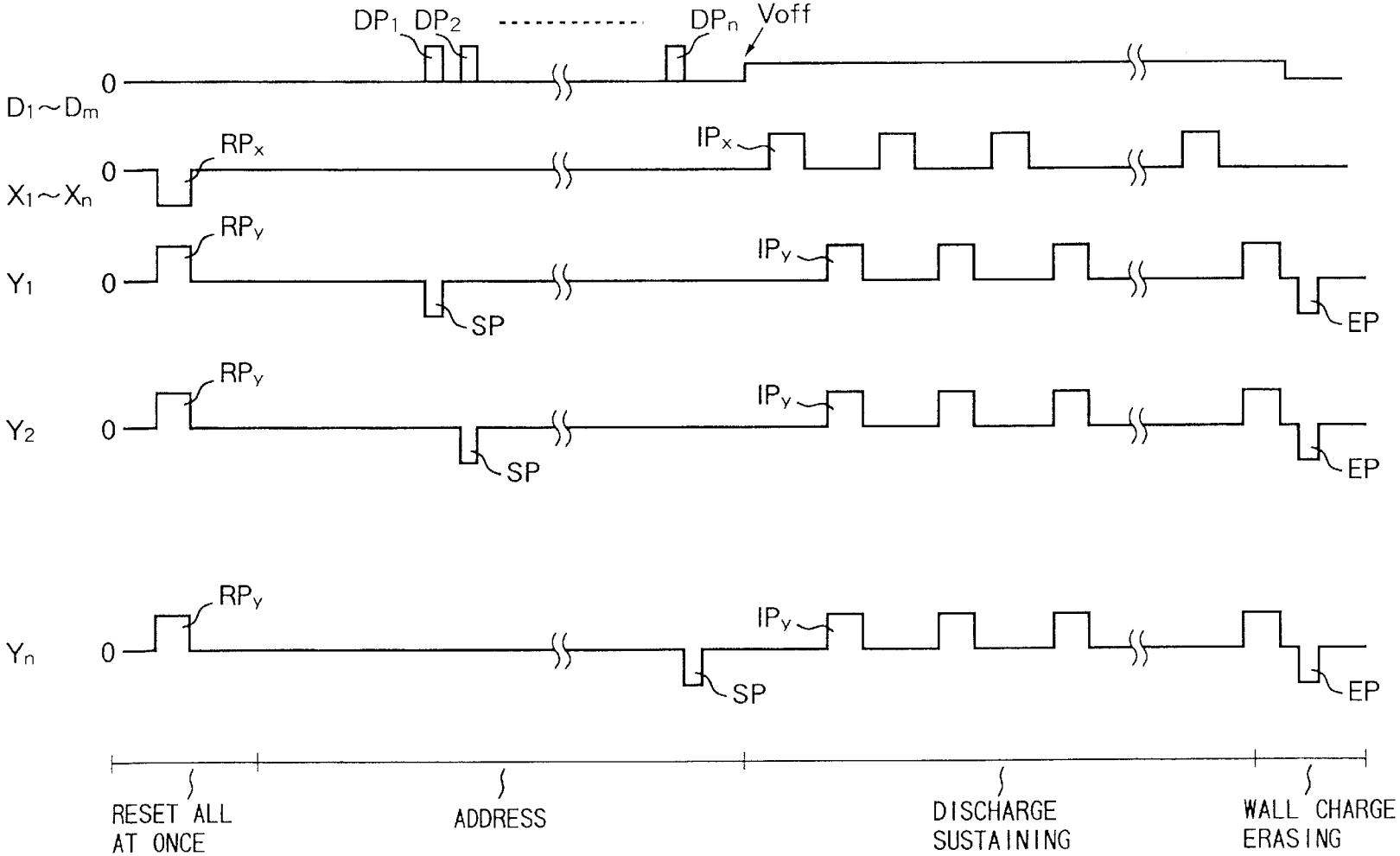
FIG. 3 is time charts showing drive signals for the plasma display panel.

Operation of the PDP 11 will be described. FIG. 3 shows a timing chart of drive signals for driving the PDP using a selecting and erasing address method.

As afore mentioned, in the PDP, the reset all at once period, address period, discharge sustaining period and wall charge erasing period are repeated as one display cycle, thereby displaying the image.

A reset pulse RPx of negative voltage is applied to each of the row electrodes X1–Xn, and a reset pulse RPy of positive voltage is applied to each of the row electrodes Y1–Yn. Thus, the row electrodes in pairs are excited to discharge at all of the discharge cells, thereby producing charged particles in the discharge space. Thereafter, when the discharge is finished, wall charge is formed and accumulated on the discharge cell (A reset all at once period).

Then, pixel data pulses DP1–DPn corresponding to the pixel data for every row are applied to the pixel data electrodes D1–Dm in order. At that time, scanning pulses (selecting and erasing pulses) SP are applied to the row electrodes Y1–Yn in order in synchronism with the timings of the data pulse DP1–DPn.

At the time, only in the discharge cell (unlighted pixel, unlighted cell) to which the scanning pulse SP and the pixel data pulse DP are simultaneously applied, the discharge occurs, so that the wall charge produced at the reset all at once period is erased.

On the other hand, in the discharge cell (lighted pixel, lighted cell) to which only the scanning pulse SP is applied, the discharge does not occur. Thus, the wall charge produced at the reset all at once period is held. Namely, the wall charge is selectively erased in accordance with the pixel data, thereby selecting a lighted pixel and an unlighted pixel (An address period).

A discharge sustaining pulse IPx of positive voltage is applied to the row electrodes X1–Xn, and a discharge sustaining pulse IPy of positive voltage is applied to each of the row electrodes Y1–Yn at offset timing from the sustaining pulses IPx.

During the sustaining pulses are applied, the discharge cell (lighted pixel, lighted cell) which holds the wall charge sustains the discharge and emission of light. On the other hand, the discharge cell (unlighted pixel, unlighted cell) in which the wall charge is disappeared does not produce the discharge and emit the light (A discharge sustaining period).

In the discharge sustaining period, an offset voltage Voff which have the same polarity as the pixel data pulse DP is applied to the data electrodes D1–Dm. The offset voltage Voff is operated to reduce the potential of the row electrode caused by the positive charge remained on the row electrode in the unlighted cell, and to reduce the electric field E caused by the potential of the data electrode. Thus, it is possible to solve the problem that the error discharge starts in the unlighted cell in the discharge sustaining period which is caused by the influence of the adjacent lighted cell.

Then, wall charge erasing pulses EP are applied to the row electrodes Y1–Yn all at once, thereby erasing the wall charges on all of the discharge cells (lighted cells) (A wall charge erasing period).

Figure 4:
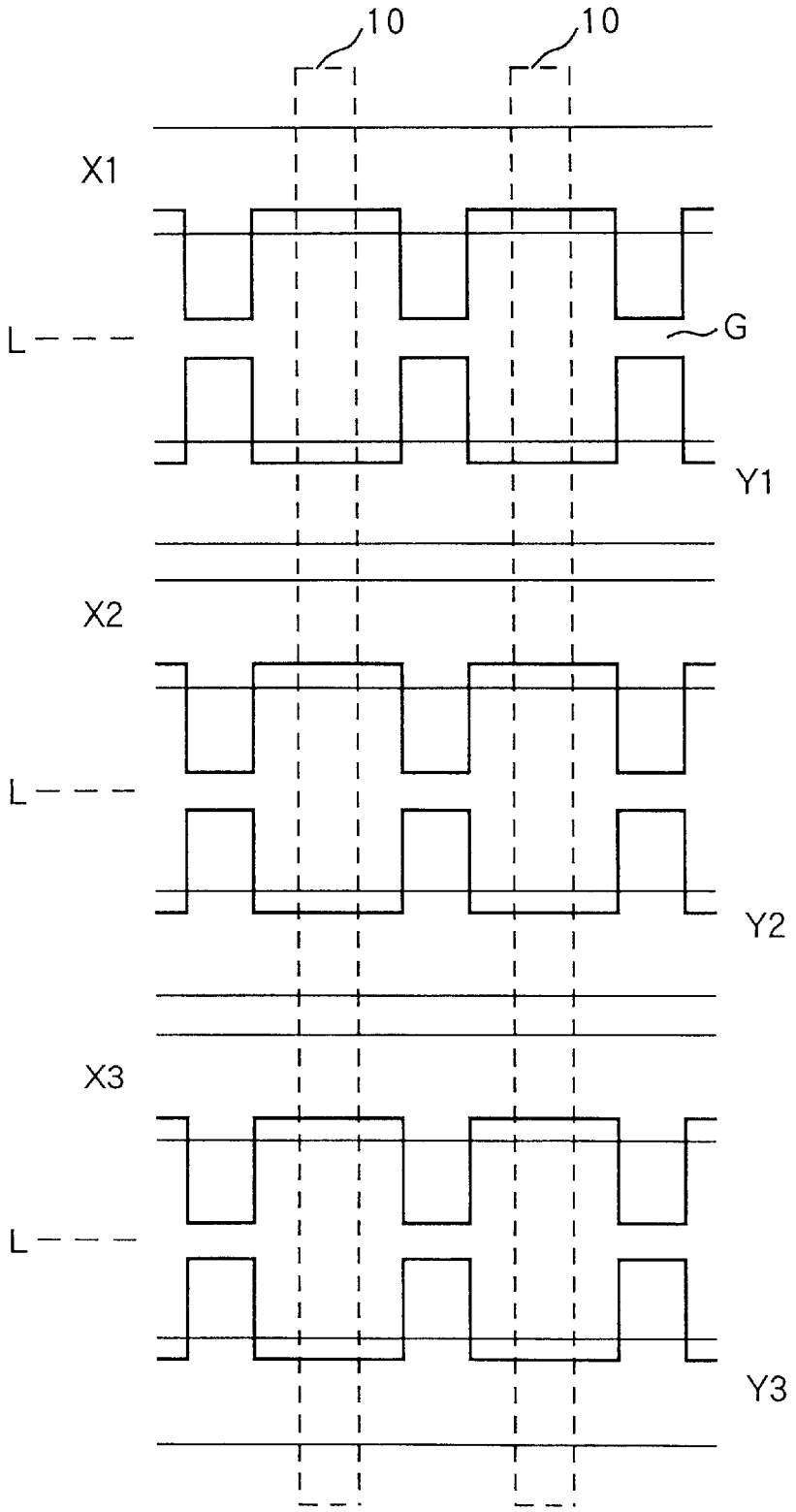
FIG. 4 is a schematic plan view showing a second embodiment of the present invention.

FIG. 4 shows a second embodiment of the PDP in which the row electrodes X and Y are alternately disposed such as X1–Yl, X2–Y2, X3–Y3.

The PDP of the second embodiment is operated in the same manner as the first embodiment, and the same effect as the first embodiment can be obtained.

Figure 5:
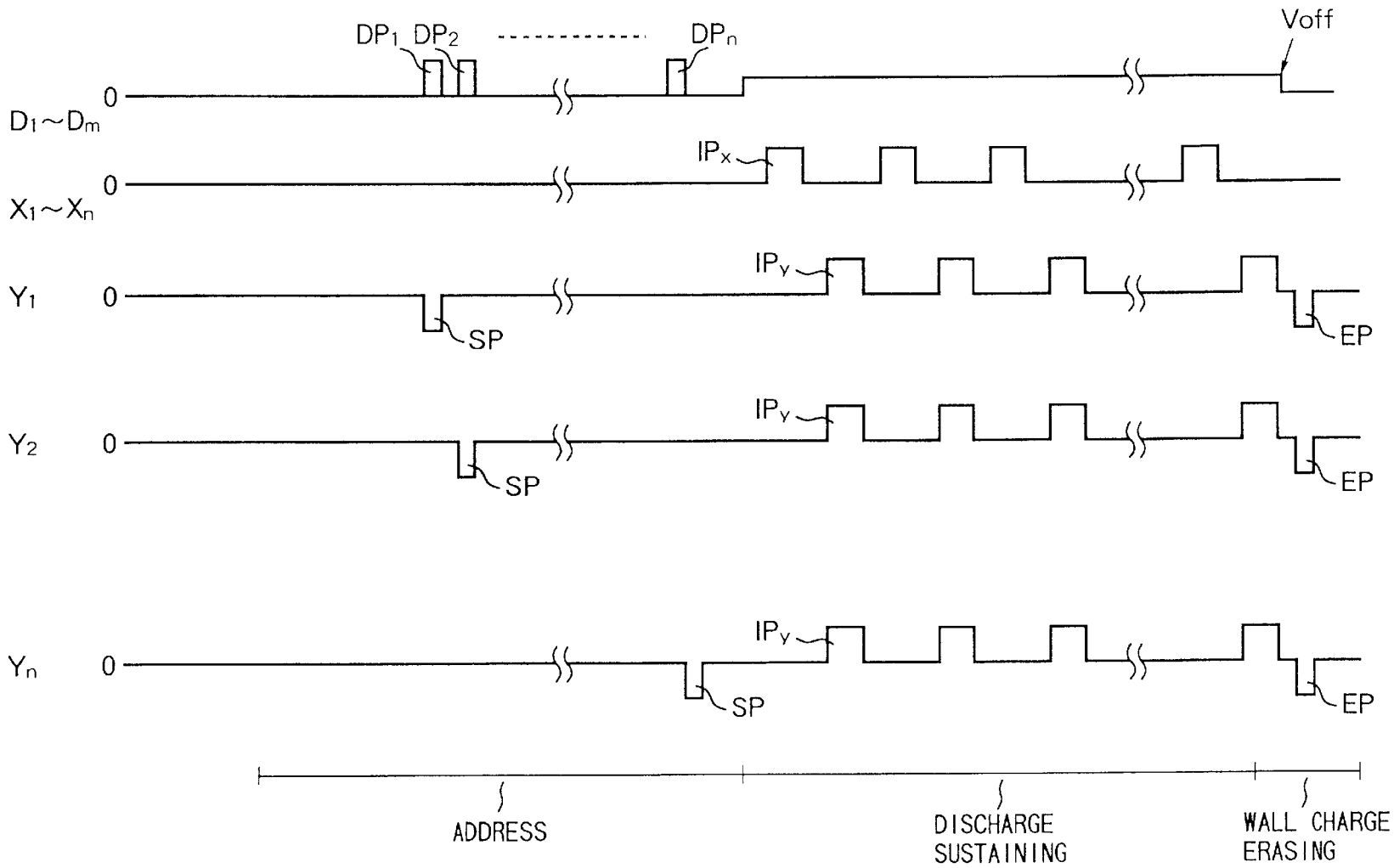
FIG. 5 is another example of time charts showing drive signals according to the present invention.
Figure 6:
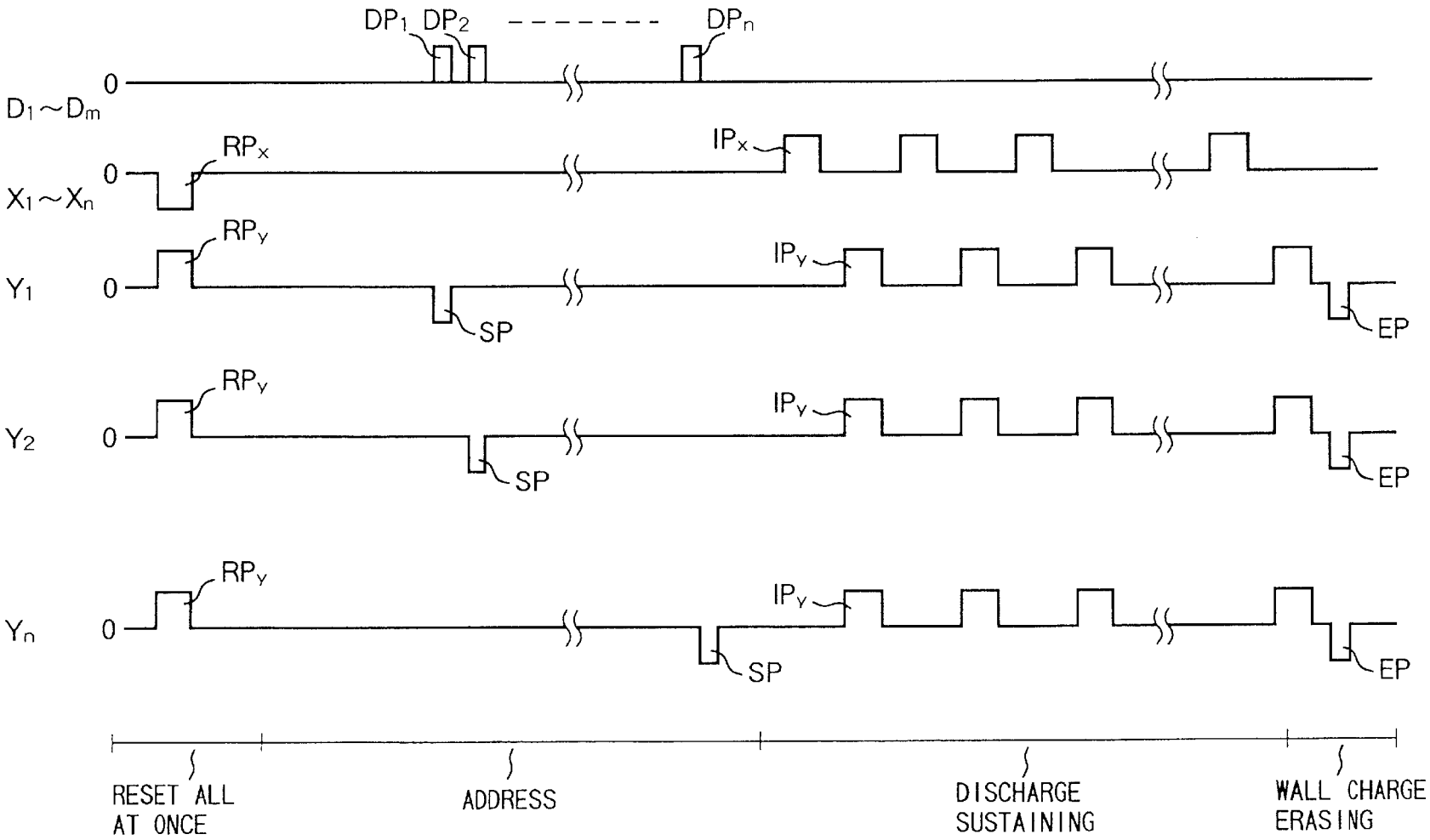
FIG.6 (PRIOR ART)
FIG. 6 is time charts showing drive signals for a conventional plasma display panel.
Figure 7A:
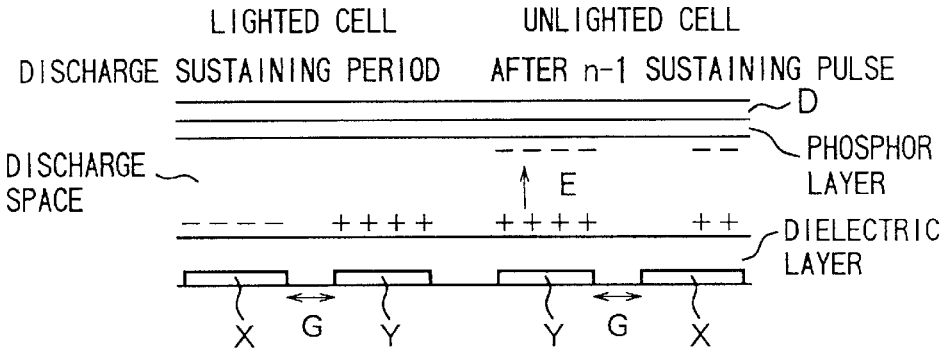
FIG.7a (PRIOR ART)
FIGS. 7*a* to 7*d* are schematic diagrams showing the conventional plasma display panel for explaining wall charges.
Figure 7B:
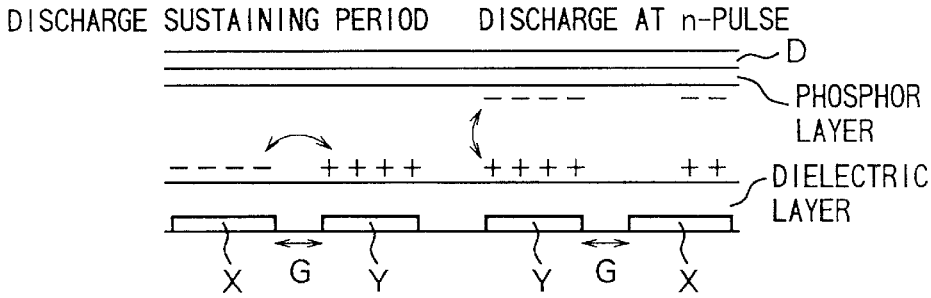
Figure 7C:
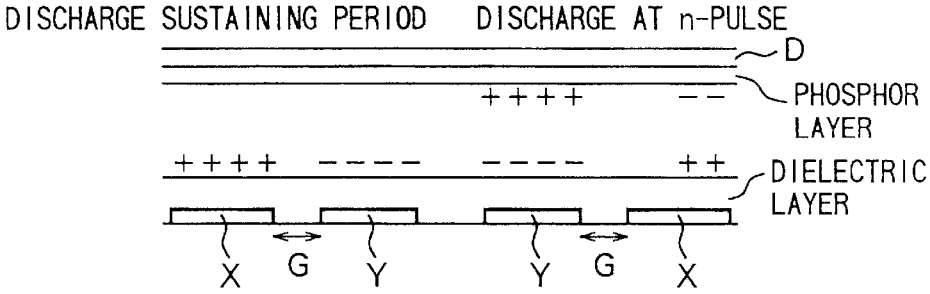
Figure 7D:
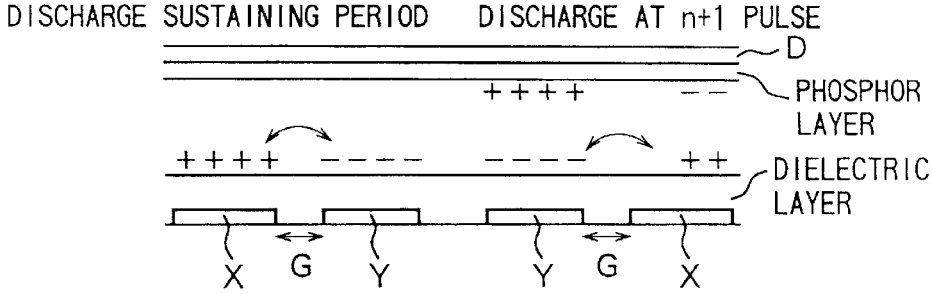

FIG. 5 shows another example of the time charts of drive signals of the present invention. In the example, in place of the selecting and erasing address method, a selecting and writing address method is employed, and the same effect as the previous embodiments can be obtained.

In accordance with the present invention, an offset voltage which has the same polarity as the pixel data pulse is applied to the data electrodes in the discharge sustaining period. The offset voltage is operated to reduce the negative potential of the data electrode to weaken the electric field from the row electrode Y to the data electrode D. Thus, the error discharge of the unlighted cell that the unlighted cell may start discharging by the influence of the adjacent lighted cell in the discharge sustaining period is prevented.

While the invention has been described in conjunction with preferred specific embodiment thereof, it will be understood that this description is intended to illustrate and not limit the scope of the invention, which is defined by the following claims.

What is claimed is:

1. A method for driving a plasma display panel having a plurality of first and second sustain electrodes, a plurality of address electrodes which intersect with the sustain electrodes to form a pixel at every intersection, an address period in which data pulses are applied to the address electrodes, and scanning pulses are applied to the second sustain electrodes, thereby selecting lighted pixels and unlighted pixels, and a discharge sustaining period in which discharge sustaining pulses are alternately applied to the first and second sustain electrodes so as to sustain the lighted and unlighted pixels, comprising:

applying an offset voltage having the same polarity as the data pulse to the address electrodes in the discharge sustaining periods;

wherein the offset voltage is applied to the address electrodes independently of the data pulses.

2. The method according to claim 1 further comprising a reset period before the address period in which a plurality of reset pulses are applied to all of the electrodes so as to form a wall charge in each of the pixels, the data pulses and scanning pulses are selectively applied to the electrodes, thereby selectively erasing the wall charges so as to select the lighted pixels and unlighted pixels.

3. A method for driving a plasma display panel having a plurality of first and second sustain electrodes, a plurality of address electrodes which intersect with the sustain electrodes to form a pixel at every intersection, an address period in which data pulses are applied to the address electrodes, and scanning pulses are applied to the second sustain electrodes, thereby selecting lighted pixels and unlighted pixels, and a discharge sustaining period in which discharge sustaining pulses are alternately applied to the first and second sustain electrodes so as to sustain the lighted and unlighted pixels, the first sustain electrode and the second sustain electrode are alternately disposed at every display line, comprising:

applying an offset voltage having the same polarity as the data pulse to the address electrodes in the discharge sustaining period;

wherein the offset voltage is applied to the address electrodes independently of the data pulses.

4. The method according to claim 3 further comprising a reset period before the address period in which a plurality of reset pulses are applied to all of the electrodes so as to form a wall charge in each of the pixels, the data pulses and scanning pulses are selectively applied to the electrodes, thereby selectively erasing the wall charges so as to select the lighted pixels and unlighted pixels.

* * * * *